US006725509B1

(12) United States Patent
Lee et al.

(10) Patent No.: US 6,725,509 B1
(45) Date of Patent: Apr. 27, 2004

(54) SEAT BELT BUCKLE

(75) Inventors: Jae-ho Lee, Seoul (KR); Jong-hoon Lee, Seoul (KR)

(73) Assignee: Delphi Automotive Systems Sungwoo Corporation, Seoul (KR)

( * ) Notice: Subject to any disclaimer, the term of this patent is extended or adjusted under 35 U.S.C. 154(b) by 17 days.

(21) Appl. No.: 09/634,485

(22) Filed: Aug. 8, 2000

(30) Foreign Application Priority Data

Aug. 17, 1999 (KR) ..... 1999-33769
Nov. 24, 1999 (KR) ..... 1999-52496

(51) Int. Cl.[7] ..... A44B 11/26
(52) U.S. Cl. ..... 24/641
(58) Field of Search ..... 24/640–642, 633

(56) References Cited

U.S. PATENT DOCUMENTS 4,182,008 A * 1/1980 Pouget
5,097,571 A * 3/1992 Fohl
5,195,224 A * 3/1993 Bock et al.
5,542,162 A * 8/1996 Biller
5,547,214 A 8/1996 Zimmerman, II et al.
5,586,782 A 12/1996 Zimmerman, II et al.
5,860,673 A 1/1999 Hasegawa et al.
6,082,481 A * 7/2000 Engler
6,216,323 B1 * 4/2001 Oyamada

FOREIGN PATENT DOCUMENTS

WO WO99/21738 5/1999

* cited by examiner

*Primary Examiner*—James R. Brittain
(74) *Attorney, Agent, or Firm*—Fish & Richardson P.C.

(57) ABSTRACT

Disclosed is a seat belt buckle. The seat belt buckle comprises a body frame; a release button slidably coupled to the body frame for unlatching a seat belt tongue from the seat belt buckle; a locking lever capable of being pivotally rotated about wings by a predetermined angle; a slider for supporting and fixing the locking lever; and an ejector for pushing the tongue in a longitudinal direction which is a lengthwise direction of the body frame. The body frame has an arch-shaped supporting beam which is integrally formed with the body frame in a manner such that the supporting beam is erected in a vertical direction. The supporting beam serves to limit movement of the slider and increase structural rigidity of the seat belt buckle. The slider has a width which is greater than that of the body frame and possesses shock-absorbing means for increasing durability of the seat belt buckle. The slider is formed with inclined projections. The release button has at least two release projections which are formed with inclined surfaces which are in turn brought into contact with the inclined projections of the slider.

5 Claims, 10 Drawing Sheets

SEAT BELT BUCKLE

BACKGROUND OF THE INVENTION

1. Field of the Invention

The present invention relates to a seat belt buckle, and more particularly, the present invention relates to a sliding button type seat belt buckle installed on a seat belt of a motor vehicle seat, wherein a release button is pressed in a direction parallel to an inserting direction of a tongue into the seat belt buckle and thereby the tongue is unlatched from the seat belt buckle.

2. Description of the Related Art

Generally, a deluxe car has basic natures such as superior running capability, comfortable on-board feeling, high running speed and the like, and at the same time, is provided with a variety of safety measures capable of ensuring safety of an occupant.

Such safety measures include a seat belt, an airbag system, a safety steering column, a pyrotechnical seat belt retractor, and so forth. These safety measures are designed in a manner such that they can be automatically actuated upon heavy impact loading, to maximally protect an occupant.

Specifically, a seat belt is provided to a front seat or a rear seat of a motor vehicle and functions to prevent an occupant from being expelled out of the vehicle due to shock which is induced upon abrupt deceleration (for example, when the motor vehicle comes into collision).

A seat belt comprises a first belt part and a second belt part. Both ends of the first belt part are secured to upper and lower ends of a pillar panel of a vehicle. One end of the second belt part is secured to a bottom surface of the vehicle. A tongue is movably coupled to the first belt part. A seat belt buckle is fastened to the other end of the second belt part.

The tongue is of a metal plate-shaped contour and has a first aperture through which the first belt part passes and a second aperture into which a lock bar of the seat belt buckle can be inserted.

Seat belt buckles are divided into push button type seat belt buckles and sliding button type seat belt buckles depending upon a manner by which a release button is pressed.

First, the push button type seat belt buckle is generally applied to a rear seat of a motor vehicle, and a tongue is latched to or unlatched from the seat belt buckle by a lock bar which is moved in a vertical direction by virtue of a thin plate-shaped spring. Such push button type seat belt buckles are disclosed in U.S. Pat. Nos. 4,127,922, 4,064,603 and 4,998,328.

The sliding button type seat belt buckle is generally applied to a front seat of a motor vehicle. In the sliding button type seat belt buckle, a release button is pressed in the same direction as an inserting direction of a tongue into the seat belt buckle, and the tongue is latched to and unlatched from the seat belt buckle by a slider and a lock bar. Such sliding button type seat belt buckles are disclosed in U.S. Pat. Nos. 5,718,020, 5,271,129 and 4,899,424.

In the sliding button type seat belt buckle, a of longitudinal direction means a lengthwise direction of a body frame, a transverse direction means a widthwise direction of the body frame, and a vertical direction means a heightwise direction of the body frame.

In the sliding button type seat belt buckle, the tongue is latched to the seat belt buckle in a manner as described below. That is, as the tongue is inserted into the buckle, an ejector is moved rearward in the longitudinal direction, and an upper end of a locking lever is pivotally rotated downward by a predetermined angle about wings of the locking lever. Then, at the same time when the lock bar of the locking lever is inserted into an aperture which is defined in the tongue, the slider is fitted into a space which is defined between a lock pin and the body frame, whereby upward pivoting rotation of the locking lever is restricted by the slider.

Further, in the sliding button type seat belt buckle, the tongue is unlatched from the seat belt buckle in a manner as described below. By pressing the release button, the slider is removed from the space which is defined between the lock pin and the body frame, and then, the upper end of the locking lever is pivotally rotated upward by the predetermined angle by means of elastic force of a first spring. Thereafter, as the ejector is moved forward in the longitudinal direction by elastic force of a second spring, the tongue is discharged out of the buckle.

As shown in FIGS. 1 and 2, the conventional seat belt buckle comprises a body frame 10 which is fastened inside a casing (not shown) of the seat belt buckle, an ejector 60 which is capable of forcing a seat belt tongue (not shown) to be discharged out of the body frame 10, a locking lever 20 is having integrally formed therewith a lock bar 22, a slider 40 which slides on the locking lever 20, and a release button 50 which can push rearward the slider 40 to remove the slider 40 from a space defined between a lock pin 13 and the body frame 10, thereby enabling the lock bar 22 of the locking lever 20 to be released from an aperture defined in the tongue.

In the conventional seat belt buckle, the body frame 10 has a base plate 16 and upstanding side walls 17 which are bent upward from respective longitudinal edges (that is, longitudinally extending edges) of the base plate 16. An ejector sliding opening 12 is defined in the base plate 16 of the body frame 10, and hinge grooves 19 are formed at upper and substantially rear ends of the upstanding side walls 17 of the body frame 10. The lock pin 13 is fitted through trapezium-shaped holes 14 which are respectively defined in the upstanding side walls 17 of the body frame 10.

The lock pin 13 which is fitted through the trapezium-shaped holes 14, functions to retain the slider 40 in the space which is defined between the lock pin 13 and the body frame 10, and support the slider 40 in the heightwise direction of the body frame 10.

Moreover, the ejector 60 has a recessed portion which is formed at a front end of the ejector 60 to be brought into contact with the tongue. The ejector 60 is formed at both sides thereof with guide wings which slide on the base plate 16 along the ejector sliding opening 12 of the body frame 10. One end of a second spring 61 is secured to a rear end of the ejector 60. The other end of the second spring 61 is secured to a first projection 15 which is formed on a rear edge of the ejector sliding opening 12 of the base plate 16. Hence, the ejector 60 can be moved along the ejector sliding opening 12 in the longitudinal direction by elastic force of the second spring 61.

Also, the release button 50 is formed, at a center portion thereof, with a release projection 53 and, at both widthwise ends thereof, with two elongate portions 51. The release projection 53 projects from the center portion of an inner surface of the release button 50 to extend in the longitudinal direction. When the release button 50 is pressed, the release projection 53 functions to remove the slider 40 from the space which is defined between the lock pin 13 and the body frame 10. To this end, the release projection 53 is formed, at a rear free end thereof, with an inclined surface. In addition, the two elongate portions 51 also extend in the longitudinal direction from both widthwise ends of the inner surface of the release button 50, so that they are perpendicular to a plane of the release button 50. Each of the two elongate portions 51 is formed, at an upper end thereof, with a slit 52.

The two elongate portions 51 of the release button 50 which is configured in the above-described way, are respectively coupled to guide rails 11 of the upstanding side walls 17 of the body frame 10 in a manner such that the two elongate portions 51 can slide on the guide rails 11 in the longitudinal direction. The two elongate portions 51 cause the release projection 53 to push rearward the slider 40 in the longitudinal direction which slider 40 is interposed between the lock pin 13 and the locking lever 20, when the release button 50 is pressed, thereby to allow an unlatching operation of the tongue from the seat belt buckle to be implemented.

Engaging projections 18 are respectively formed on walls defining the hinge grooves 19 of the body frame 10 in a manner such that the engaging projections 18 project forward in the longitudinal direction. Wings 21 of the locking lever 20 are hingedly engaged into the hinge grooves 19. As described above, the locking lever 20 has integrally formed therewith the lock bar 22 which projects downward. The locking lever 20 is formed with a second projection 24. The other end of the first spring 42 which is secured at one end thereof to the slider 40, is secured to the second projection 24. The locking lever 20 also has at a rear end thereof integrally formed therewith legs 25. The legs 25 are bent substantially perpendicularly to a plane of the locking lever 20 to extend downward, thereby allowing the unlatching operation of the tongue from the seat belt buckle to be implemented. Here, when the ejector 60 is moved rearward in the longitudinal direction, the legs 25 of the locking lever 20 are brought into direct contact with a rear end surface of the ejector 60, thereby to undertake the unlatching operation of the tongue from the seat belt buckle.

The locking lever 20 has both side end surfaces 23 which extend straight. Guiders 41 of the slider 40 can slide on both the side end surfaces 23 of the locking lever 20. At front ends of the side end surfaces 23 of the locking lever 20, there are respectively formed stopper projections 23*a*.

Further, the slider 40 has an inclined surface which can be brought into contact with the inclined surface of the release projection 53 of the release button 50 thereby to be pushed rearward.

The slider 40 is molded from polyoxymethylene-type acetal resin which is produced by polymerization of formaldehyde. When the locking lever 20 is moved to a latching position with the aid of the elastic force of the first spring 24, so as to latch the tongue to the seat belt buckle, the slider 40 forces the lock bar 22 of the locking lever 20 to be inserted into the aperture which is defined in the tongue.

In the conventional seat belt buckle, in order to unlatch the tongue from the seat belt buckle, the release button 50 is pressed. By this, the release button 50 is moved inward of the body frame 10. By the release button 50 which is moved in this way, the slider 40 is pushed rearward along both the side end surfaces 23 of the locking lever 20. At this time, the slider 40 is pivotally rotated upward along with the locking lever 20 by the elastic force of the first spring 42 through a predetermined angle. Thereupon, the lock bar 22 of the locking lever 20 is released from the aperture which is defined in the tongue. Accordingly, the ejector 60 discharges the tongue out of the body frame 10 while being moved forward by the elastic force of the second spring 61.

However, the conventional seat belt buckle constructed as mentioned above, suffers from defects in that, since the body frame 10 and the lock pin 13 are separately manufactured and then assembled, the seat belt buckle has relatively an infirm framework, and thereby, the lock bar 22 of the locking lever 20 can be unexpectedly released from the aperture in the tongue, whereby an abnormal unlatching phenomenon can occur as if the ejector 60 is actuated to discharge the tongue out of the seat belt buckle.

Also, in the conventional seat belt buckle, because the slider 40 does not have any vibration-absorbing means, the slider 40 can be deformed when the tongue is latched to the seat belt buckle or by heavy impact force induced upon a motor accident.

Further, in the conventional seat belt buckle, due to the fact that the release projection 53 is formed at the center portion of the release button 50, uniform and horizontal pressing force cannot be applied to the slider 40 through the release projection 53. Therefore, the slider 40 cannot slide on the locking block 20 along a true horizontal path, whereby a smooth and precise operation of the seat belt buckle is not guaranteed.

Moreover, in the conventional seat belt buckle, since the stopper projections 23*a* are formed at front ends of the side end surfaces 23 of the locking lever 20 so as to limit the sliding movement of the guiders 41 of the slider 40, in order to secure a sliding distance of the slider 40, a longitudinal length of the locking lever 20 cannot but be increased, whereby a compact structure cannot not be accomplished.

Furthermore, in the conventional seat belt buckle, in the case that the longitudinal length of the locking lever 20 is increased, downward pivoting rotation, through the predetermined angle, of the upper end of the locking lever 20 is slowed, whereby operational reliability of the seat belt buckle is deteriorated.

SUMMARY OF THE INVENTION

Accordingly, the present invention has been made in an effort to solve the problems occurring in the related art, and an object of the present invention is to provide a seat belt buckle which includes a built-in type body frame, a locking lever having a compact structure and a slider having excellent vibration and shock-absorbing characteristic and dynamic stability, thereby accomplishing durability and operational reliability.

Another object of the present invention is to provide a seat belt buckle which possesses a switching structure using a hall sensor so as to allow an occupant to visibly confirm latched and unlatched conditions of the seat belt buckle, thereby providing information about an operational status of the seat belt buckle to the occupant.

Still another object of the present invention is to provide a seat belt buckle in which main internal structural components such as a body frame, and so on, are firmly and stably maintained by a rigid coupling structure of upper and lower casings.

In order to achieve the above objects, according to one aspect of the present invention, there is provided a seat belt buckle comprising: a body frame; a release button slidably coupled to the body frame for unlatching a seat belt tongue from the seat belt buckle; a locking lever capable of being pivotally rotated about wings by a predetermined angle; a slider for supporting and fixing the locking lever; and an ejector for pushing the tongue in a longitudinal direction which is a lengthwise direction of the body frame; the body frame having an arch-shaped supporting beam which is integrally formed with the body frame in a manner such that the supporting beam is erected in a vertical direction, the supporting beam serving to limit movement of the slider and increase structural rigidity of the seat belt buckle; the slider having a width which is greater than that of the body frame and possessing shock-absorbing means for increasing durability of the seat belt buckle, the slider being formed with inclined projections; and the release button having at least two release projections which are formed with inclined surfaces which are in turn brought into contact with the inclined projections of the slider.

BRIEF DESCRIPTION OF THE DRAWINGS

The above objects, and other features and advantages of the present invention will become more apparent after a reading of the following detailed description when taken in conjunction with the drawings, in which.

DETAILED DESCRIPTION OF PREFERRED EMBODIMENTS

Figure 1:
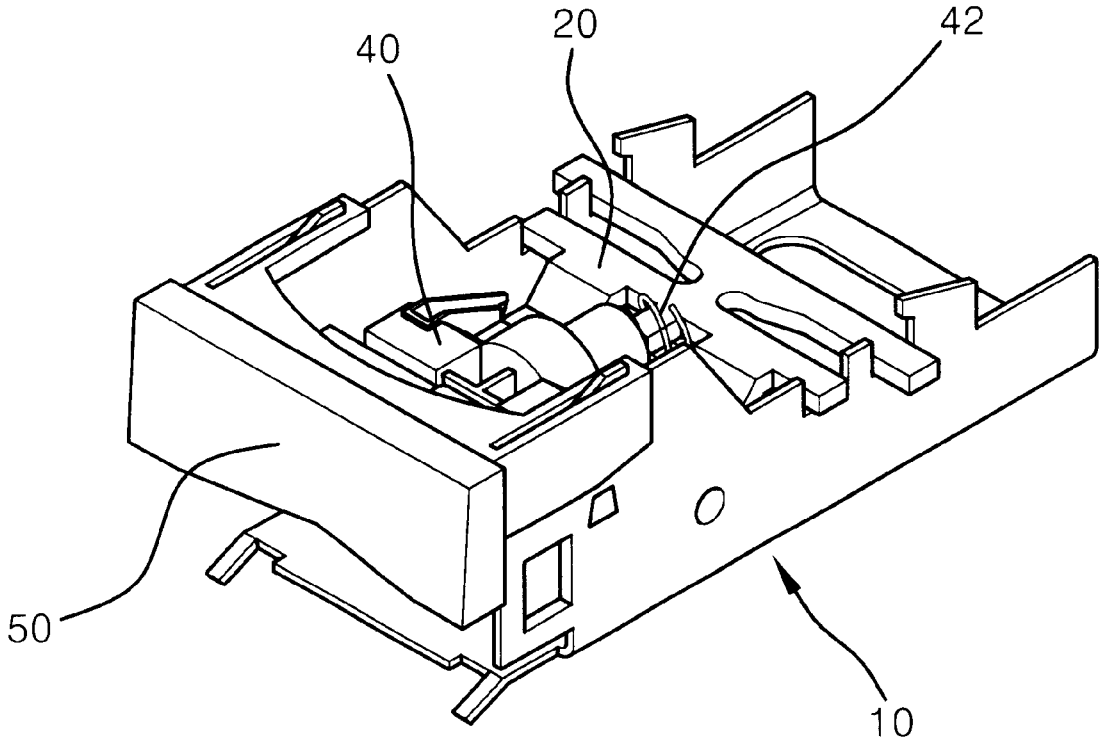
FIG. 1 (PRIOR ART)
FIG. 1 is a perspective view for explaining a construction of a seat belt buckle according to the conventional art.
Figure 2:
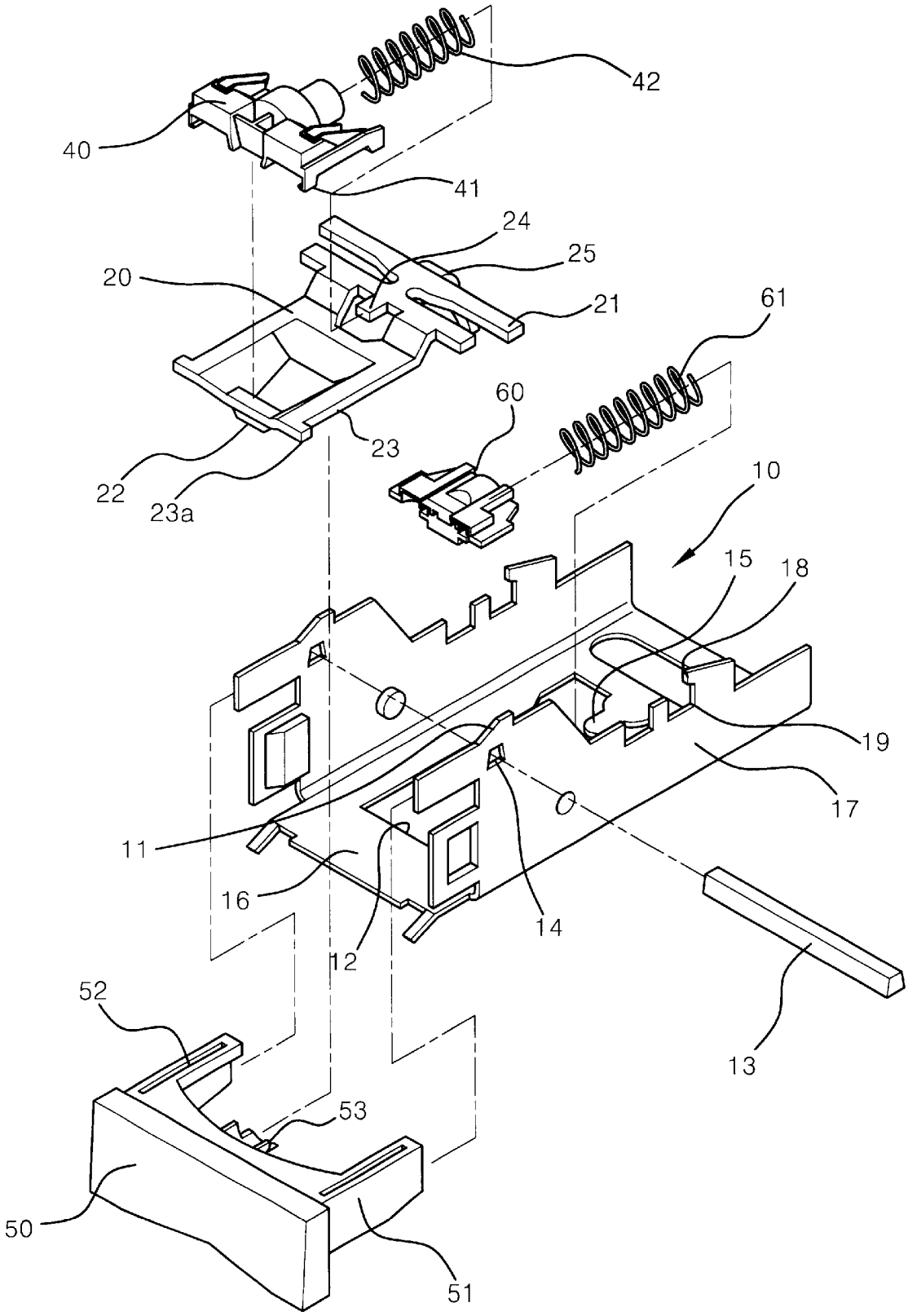
FIG. 2 (PRIOR ART)
FIG. 2 is an exploded perspective view for explaining an assembling relationship and an operating pattern of the seat belt buckle shown in FIG. 1.

Reference will now be made in greater detail to a preferred embodiment of the invention, an example of which is illustrated in the accompanying drawings. Wherever possible, the same reference numerals will be used throughout the drawings and the description to refer to the same or like parts.

Figure 3:
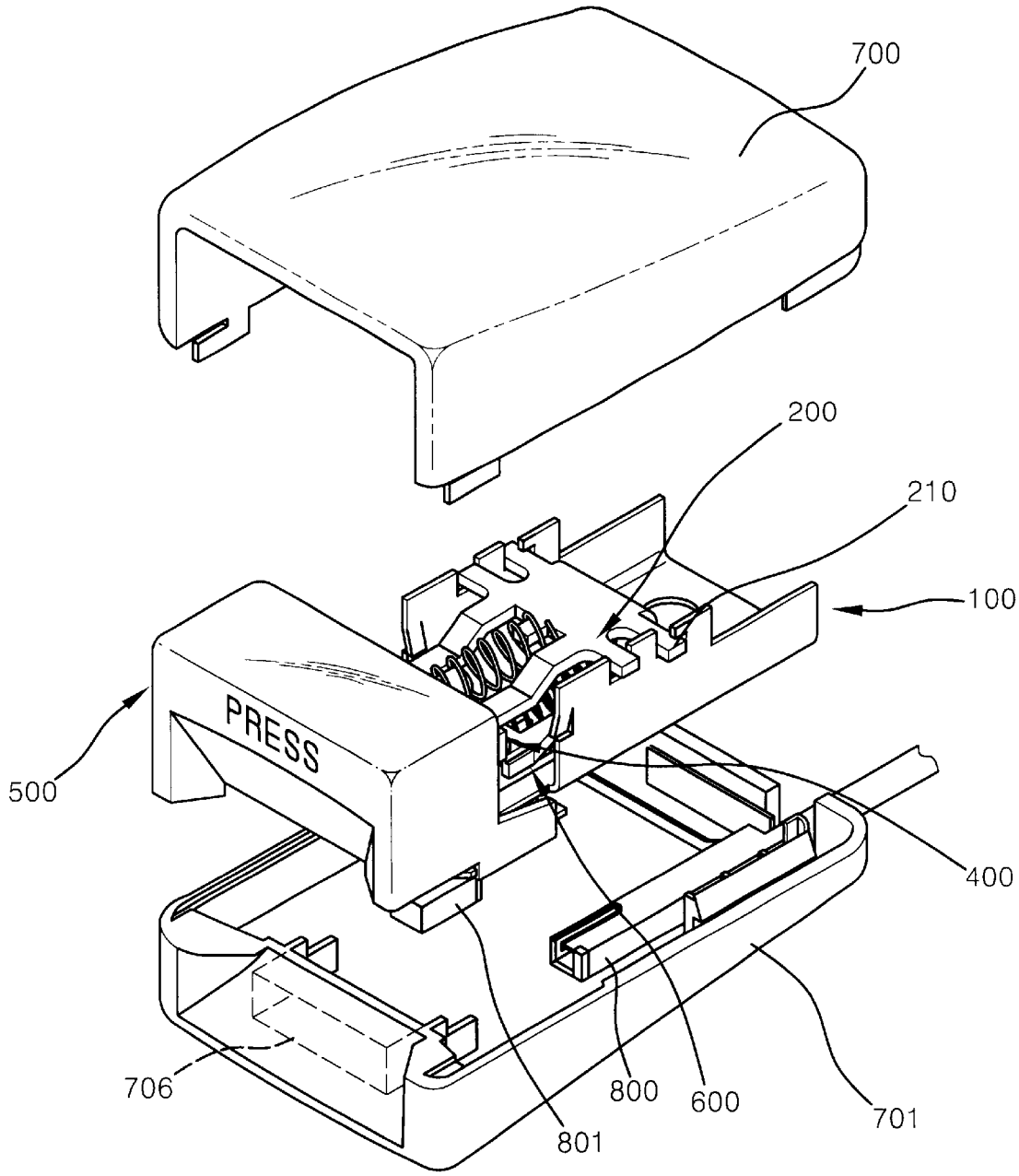
FIG. 3 is a perspective view illustrating a seat belt buckle in accordance with an embodiment of the present invention, wherein upper and lower casings are decoupled from a buckle assembly for explaining a construction of the seat belt buckle according to the present invention.
Figure 4:
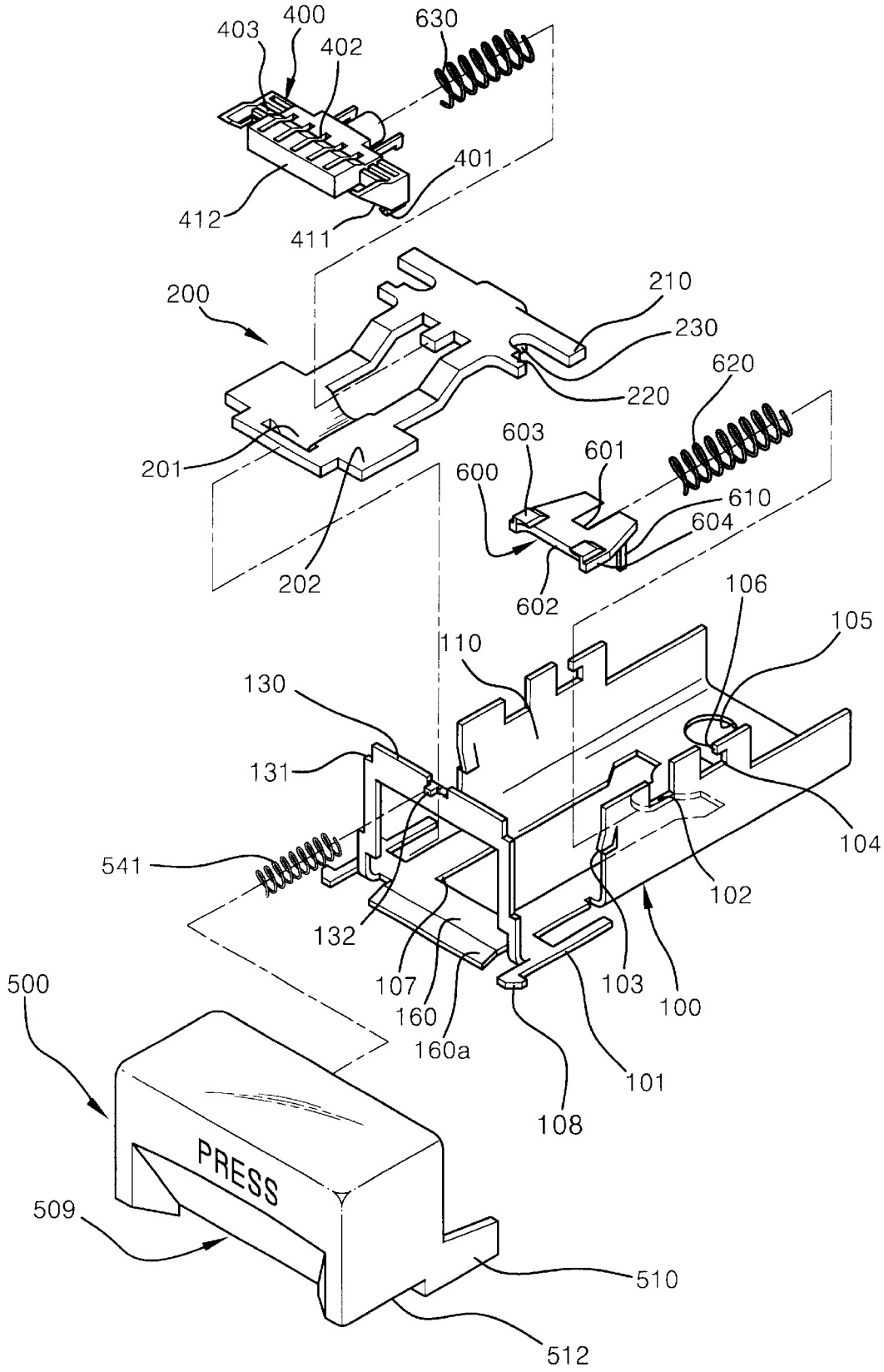
FIG. 4 is an exploded perspective view for explaining an assembling relationship of the seat belt buckle shown in FIG. 3.

Referring to FIGS. 3 and 4, a seat belt buckle in accordance with an embodiment of the present invention includes a buckle assembly, and upper and lower casings 700 and 701.

The buckle assembly includes a body frame 100, a release button 500 for enabling a tongue (not shown) to be unlatched from the buckle assembly, a locking lever 200 capable of being pivotally rotated by a predetermined angle about wings 210 thereof, a slider 400 capable of maintaining the locking lever 200 in a position for latching the tongue to the buckle assembly, and an ejector 600 for pushing forward the tongue in a longitudinal direction which is a lengthwise direction of the body frame 100.

In the seat belt buckle according to the present invention, hall sensors 800 and 801 which are a kind of contact sensors, are located on an inner surface of the lower casing 701. Here, the hall sensors 800 and 801 sense a position of the ejector 600, thereby enabling an occupant of a motor vehicle to confirm an operational status of the seat belt buckle. To this end, the hall sensors 800 and 801 function to switch on and off a lamp (not shown) for the hall sensors 800 and 801, which lamp is installed on an instrument panel disposed inside a cabin of the motor vehicle.

The body frame 100 of the buckle assembly is designed in a manner such that at least one structural component which constitutes the seat belt buckle, can be integrated with the body frame 100. In other words, in the body frame 100, upstanding side walls 110 and an arch-shaped supporting beam 130 are integrated with a base plate 160 by performing a pressing process for a single plate member. Here, both upper end corners of the supporting beam 130 are formed with L-shaped guiding parts 131 for guiding sliding movement of the release button 500 while minimizing oscillation of the release button 500. Also, it is preferred that the upstanding side walls 110 of the body frame 100 have release-preventing pieces 103 which are formed by cutting and bending portions of the upstanding side walls 110. The release-preventing pieces 103 serve to prevent the ejector 600 from being released out of the body frame 100 while the ejector 600 slides on the base plate 160.

A first projection 132 is arranged at a center portion of an upper end of the supporting beam 130. The first projection 132 is bent forward perpendicularly to a plane of the supporting beam 130 in a manner such that the first projection 132 extends in the longitudinal direction. The first projection 132 functions to secure one end of a first spring 541. An ejector sliding opening 107 along which the ejector 600 can slide on the base plate 160 of the body frame 100, is defined in the base plate 160. Also, a seat belt hole 105 through which a seat belt is connected to the body frame 100, is defined in the base plate 160. A front end of the base plate 160 is formed with a frame fixing end 160*a*. The frame fixing end 160*a* is fitted into a fitting groove 706 which is defined in the lower casing 701, so as to fix the body frame 100 to the lower casing 701. First guiding portions 101 for the release button 500 are integrally formed with the body frame 100 adjacent to the front end and both widthwise ends of the base plate 160 in a manner such that the first guiding portions 101 extend in the longitudinal direction. First release-preventing projections 108 are formed at front ends of the first guiding portions 101 in a manner such that the first release-preventing projections 108 project in a transverse direction which is a widthwise direction of the body frame 100. The first release-preventing projections 108 function to prevent two first sliding holders 510 which are formed in the release button 500, from being released out of the body frame 100. Stopper grooves 102 and hinge grooves 104 are defined on upper ends of the upstanding side walls 110. Here, hinge projections 106 are respectively formed at portions of the upstanding side walls 110 which portions define the hinge grooves 104, so that the hinge projections 106 project forward in the longitudinal direction. The hinge projections 106 enable wings 210 of the locking lever 200 to be stably maintained in a state wherein the wings 210 are engaged into the hinge grooves 104, respectively. Also, stopper shafts 220 of the locking lever 200 are engaged into the stopper grooves 102, respectively, to limit the pivoting rotation of the locking lever 200 to the predetermined angle.

As can be readily seen from the above statements, due to the integrated structure of the body frame 100, structural stability and durability of the seat belt buckle are ensured and manufacturing cost of the seat belt buckle is reduced.

Figure 5A:
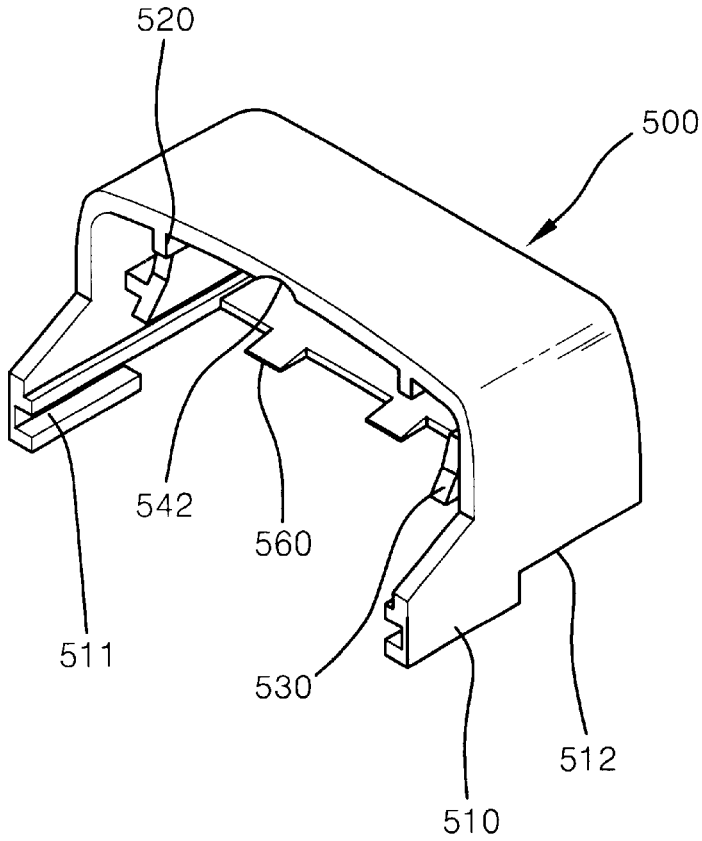
FIGS. 5A and 5B are respectively a perspective view and a rear view for explaining in detail a release button of the seat belt buckle shown in FIG. 4.
Figure 5B:
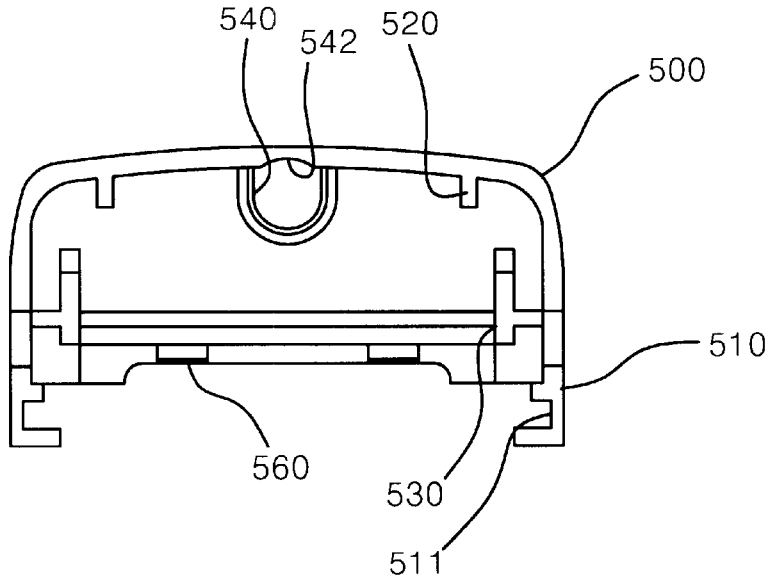

Referring to FIGS. 4, 5A and 5B, an inlet opening 509 through which the seat belt tongue is inserted into the seat belt buckle, is defined at a lower end of the release button 500. Two rails 520 are formed on an inner surface of an upper wall of the release button 500. The rails 520 project downward and extend in the longitudinal direction. The rails 520 are engaged to the L-shaped guiding parts 131 as aforementioned above, and thereby function to guide the sliding movement of the release button 500 on the base plate 160 of the body frame 100. That is to say, the rails 520 cooperate with the L-shaped guiding parts 131 to minimize oscillation of the release button 500 due to non-uniformity in pressing force for the release button 500.

Each of the first sliding holders 510 of the release button 500 has a stepped portion 512 which is engaged with a corresponding surface of the lower casing 701 and a first groove 511 which is defined on an inner surface thereof. The first guiding portions 101 for the release button 500 are slidably engaged into the first grooves 511, respectively. At this time, due to the fact that the first release-preventing projections 108 of the first guiding portions 101 are stopped by end portions of the first sliding holders 510 which portions define the first grooves 511, the release button 500 is prevented from being released from the first guiding portions 101 of the body frame 100.

The release button 500 has two release projections 530 each of which has an inclined surface. The release projections 530 function to push rearward the slider 400 by way of their inclined surfaces, thereby to allow the slider 400 to be pivotally rotated upward by the predetermined angle. Also, the release button 500 has a first spring seating portion 540. The first spring seating portion 540 renders a space into which the other end of the first spring 541 is inserted. As described above, the one end of the first spring 541 is secured to the first projection 132 of the supporting beam 130. In order to ensure the fact that the other end of the first spring 541 is smoothly inserted into the first spring seating portion 540, a crescent-shaped groove 542 which has the same curvature as the first spring seating portion 540, is defined on the inner surface of the upper wall of the release button 500. Two shock-absorbing projections 560 are formed on inner surfaces and at a lower end of a rear wall of the release button 500, in a manner such that the two shock-absorbing projections 560 project in the same direction as the first sliding holders 510. After the ejector 600 which is held pushed rearward, is moved forward by elastic force of a second spring 620, and immediately before the ejector 600 reaches a front end of the ejector sliding opening 107, the shock-absorbing projections 560 are brought into contact with second release-preventing projections 603 of the ejector 600 to stop the ejector 600. Namely, the shock-absorbing projections 560 function not to allow ejecting force of ejector 600 to be transmitted to the body frame 100 while the ejector 600 is moved forward on the base plate 160 of the body frame 100.

Figure 6A:
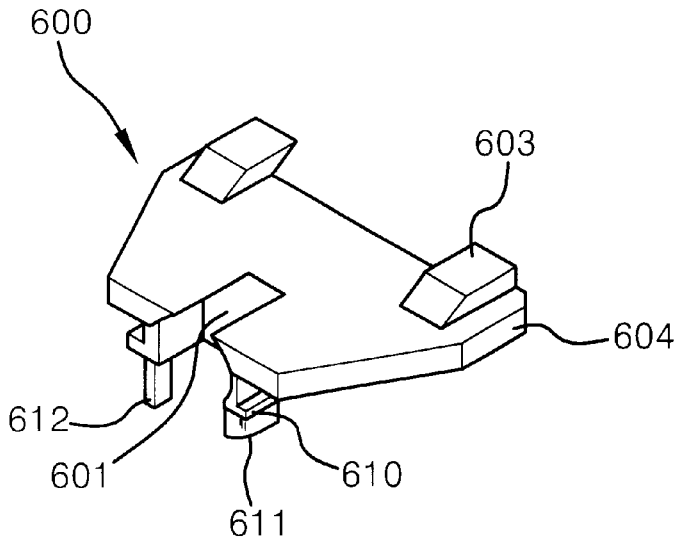
FIGS. 6A and 6B are respectively a perspective view and a bottom view for explaining in detail an ejector of the seat belt buckle shown in FIG. 4.
Figure 6B:
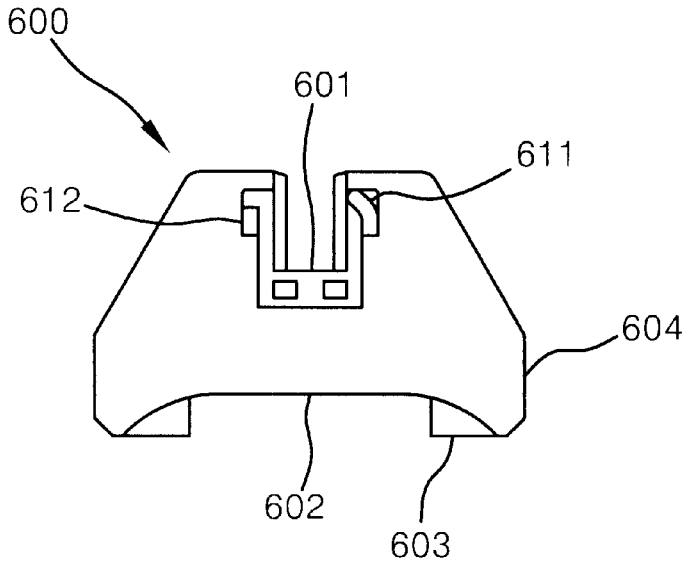

Referring to FIGS. 4, 6A and 6B, the ejector 600 has an upper board which has substantially a thin plate-shaped configuration and guide wings 604 which are formed at both sides of a front end of the upper board, with the front end diverged forward. The ejector 600 further has a spring fixing end 601 for securing one end of a second spring 620. Two second sliding holders 610 are formed on a lower surface of the ejector 600. The second sliding holders 610 are fitted into the ejector sliding opening 107 which is defined in the base plate 160. Two hall sensor projections 611 and 612 are projectedly formed on lower surfaces of the second sliding holders 610, respectively. The hall sensor projections 611 and 612 function to switch on and off the hall sensors 800 and 801, respectively, which are a kind of contact sensors. In the ejector 600, a recessed portion 602 which has an inward curved contour, is formed at the front end of the upper board, whereby reliable contact between the seat belt tongue and the recessed portion 602 is ensured. Further, the two second release-preventing projections 603 are formed on an upper surface of the upper board of the ejector 600. The second release-preventing projections 603 function to prevent the tongue from being released out of engagement with the ejector 600. Also, the second release-preventing projections 603 perform the shock-absorbing function as stated above.

The ejector 600 which is structured as described above, is not released out of the ejector sliding opening 107 of the body frame 100 in a vertical direction which is a heightwise direction of the body frame 100 and instead, smoothly slides on the base plate 160 of the body frame 100.

Figure 7:
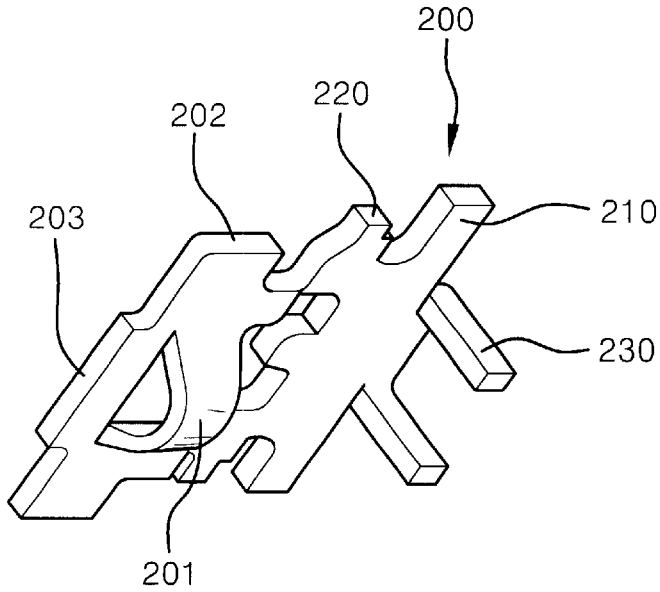
FIG. 7 is a perspective view for explaining in detail a locking lever of the seat belt buckle shown in FIG. 4.

Referring to FIGS. 4 and 7, the locking lever 200 is formed by performing a pressing process for a plate-shaped member. The locking lever 200 has integrally formed therewith a linear engaging projection 203. The linear engaging projection 203 is formed at a front end of the locking lever 200. The engaging projection 203 is engaged into the supporting beam 130 of the body frame 100 from the inside toward the outside, and functions to effectively prevent deformation of the locking lever 200 even when heavy impact load is unexpectedly applied to the locking lever 200. Also, the locking lever 200 has integrally formed therewith a lock bar 201. The lock bar 201 is bent downward from a plane of the locking lever 200 thereby to projectedly extend downward. The lock bar 201 has a semi-circular configuration, which allows the lock bar 201 to be easily inserted into an aperture defined in the tongue. The locking lever 200 further has integrally formed therewith second guiding portions 202 for the slider 400. The second guiding portions 202 for the slider 400 are respectively formed at both sides of the locking lever 200 adjacent to the front end of the locking lever 200. The second guiding portions 202 for the slider 400 slightly project in the widthwise direction in a manner such that they can effectively guide sliding movement of the slider 400. The locking lever 200 still further has integrally formed therewith the wings 210 and the stopper shafts 220. The wings 210 and the stopper shafts 220 are respectively engaged into the hinge grooves 104 and the stopper grooves 102 which are defined at the upper end of the upstanding side walls 110. Two legs 230 are formed at a rear end of the locking lever 200. The legs 230 are formed by cutting and bending downward portions of locking lever 200 through a pressing process. The two legs 230 of the locking lever 200 are brought into contact with the ejector 600 which is moved rearward by the insertion of the tongue into the seat belt buckle, and thereby, function to pivotally rotate downward the locking lever 200 about the wings 210 by the predetermined angle.

Figure 8A:
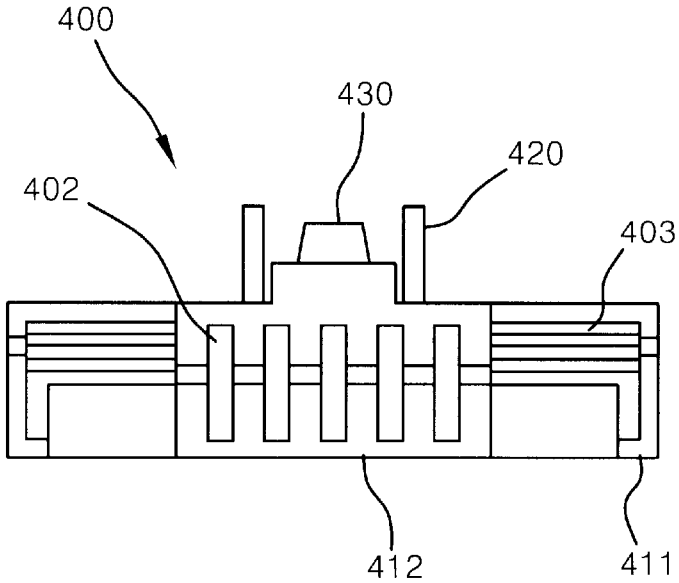
FIGS. 8A and 8B are respectively a plan view and a side view for explaining in detail a slider of the seat belt buckle shown in FIG. 4.
Figure 8B:
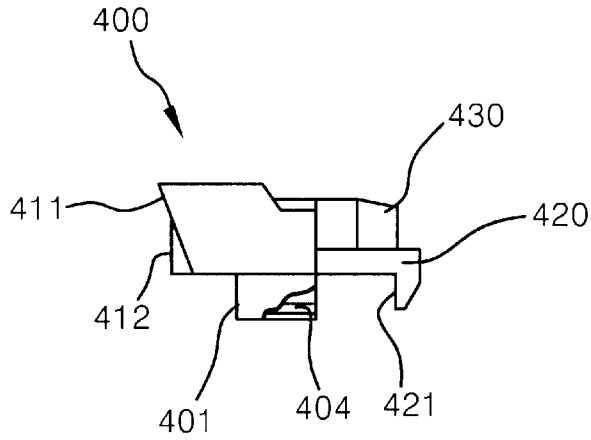

Referring to FIGS. 4, 8A and 8B, the slider 400 which is biased by a third spring 630, is slidably coupled to the locking lever 200. The slider 400 has a width which is greater than that of the body frame 100, and possesses at both widthwise ends thereof two inclined projections 411. Each of the inclined projections 411 has an inclined surface which is slidably engaged with the inclined surface of the release projection 530 of the release button 500. The inclined projections 411 project forward in the longitudinal direction at both the widthwise ends of the slider 400, so that the slider 400 is prevented from fluctuating when pressing force is transmitted to the slider 400 from the release button 500.

The slider 400 has shock-absorbing means for increasing durability of the seat belt buckle. The shock-absorbing means comprises a plurality of shock-absorbing grooves 402 and 403 which are defined on an upper surface of a damping block 412 in a manner such that they extend in the longitudinal and transverse directions. The plurality of grooves 402 and 403 of the damping block 412 function to absorb shock which is generated when the tongue is latched to and unlatched from the seat belt buckle and is transmitted through the locking lever 200, whereby durability of the seat belt buckle is increased.

Third sliding holders 401 are projectedly formed on a lower surface and at both the widthwise ends of the slider 400. Here, the third sliding holders 401 are bent inward at lower ends thereof to define second grooves 404, in a manner such that the second guiding portions 202 of the locking lever 200 are slidably engaged into the second grooves 404 defined in the third sliding holders 401. The slider 400 is formed with two hooks 420 for improving assemblability between the slider 400 and the locking lever 200. Here, the hooks 420 are coupled to the locking lever 200 at preset positions by the medium of projected portions 421 which project downward from distal ends of the hooks 420. The hooks 420 function to fixedly maintain the slider 400 while the slider 400 is assembled to the locking lever 200, thereby to prevent the slider 400 from being detached from the locking lever 200 by elastic force of a third spring 630. A second spring seating portion 430 for securing one end of the third spring 630 is projectedly formed at a center portion of a rear end surface of the slider 400.

Figure 9A:
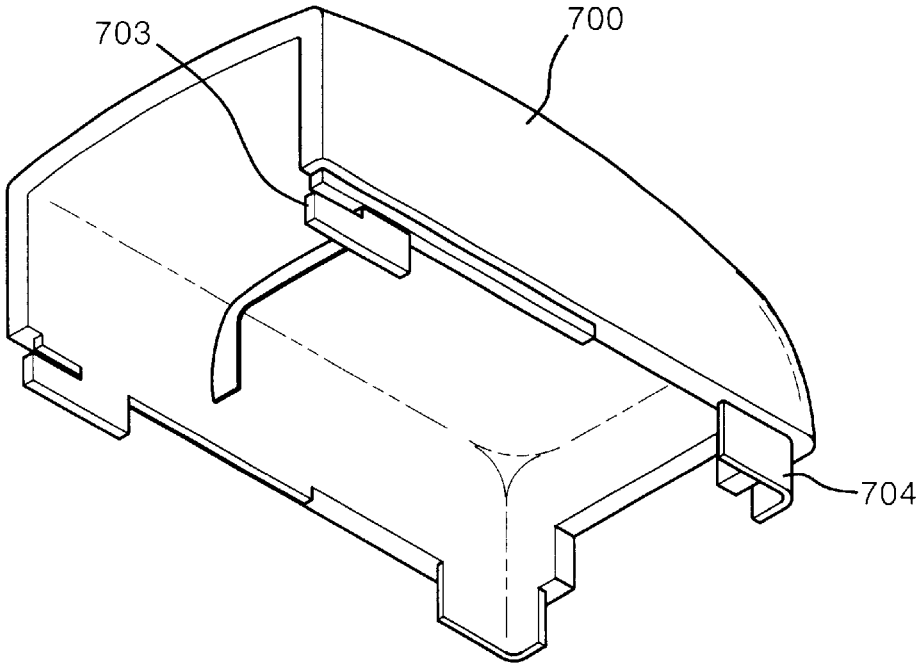
FIGS. 9A and 9B are perspective views for explaining in detail the upper and lower casings, respectively, of the seat belt buckle shown in FIG. 4.
Figure 9B:
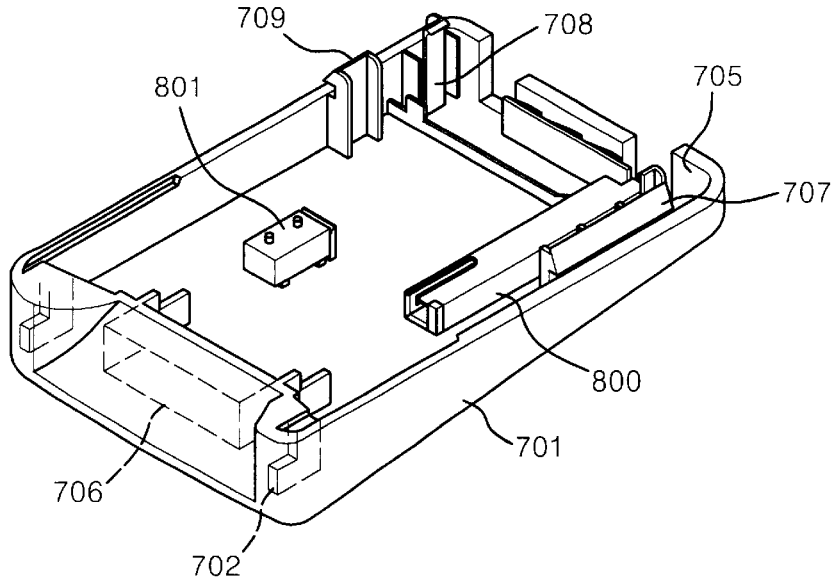

Referring to FIGS. 9A and 9B, the upper and lower casings 700 and 701 are configured in a manner such that they can be assembled with each other to envelope the buckle assembly constructed as mentioned above, before they are molded by plastic.

The upper casing 700 has clamps 703 and inserting ends 704 which are projectedly formed on a lower surface of a side wall of the upper casing 700. The clamps 703 and the inserting ends 704 are respectively fitted into clamp grooves 702 and rear corner portions 705 of the lower casing 701.

The lower casing 701 has first hooks 707 and 709 which are formed in a manner such that they project upward from an inner surface of a side wall of the lower casing 701 so as to be assembled to the upper casing 700. The hall sensors 800 and 801 are installed at present positions on the inner surface of a bottom wall of the lower casing 701.

Upon assembling the lower casing 701, the frame fixing end 160*a* of the body frame 100 is fitted into the fitting groove 706, and a rear end of the body frame 100 of the buckle assembly is fastened to the inner casing 701 using a second hook 708.

At this time, as described above, the clamps 703 and the inserting ends 701 of the upper casing 700 are securely fitted into the clamp grooves 702, the rear corner portions 705 and the first hooks 707 and 709 of the lower casing 701. Thereafter, the upper casing 700 and the lower casing 701 are fused to each other by ultrasonic welding, in a manner such that they are not detached from each other even upon transmission of shock.

Hereinafter, an operation of the buckle assembly which is constructed as mentioned above to constitute a main section of the seat belt buckle according to the present invention, will be described with reference to FIGS. 10A through 10C.

Figure 10A:
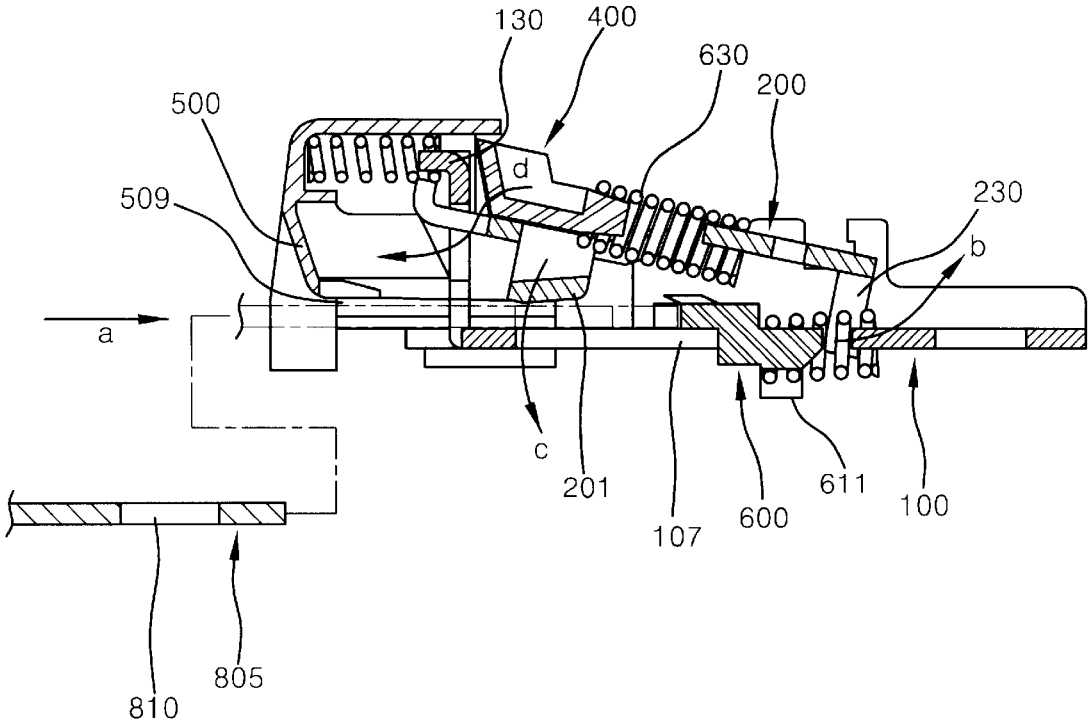
FIGS. 10A through 10C are cross-sectional views for explaining an operating pattern of the seat belt buckle shown in FIG. 4.
Figure 10B:
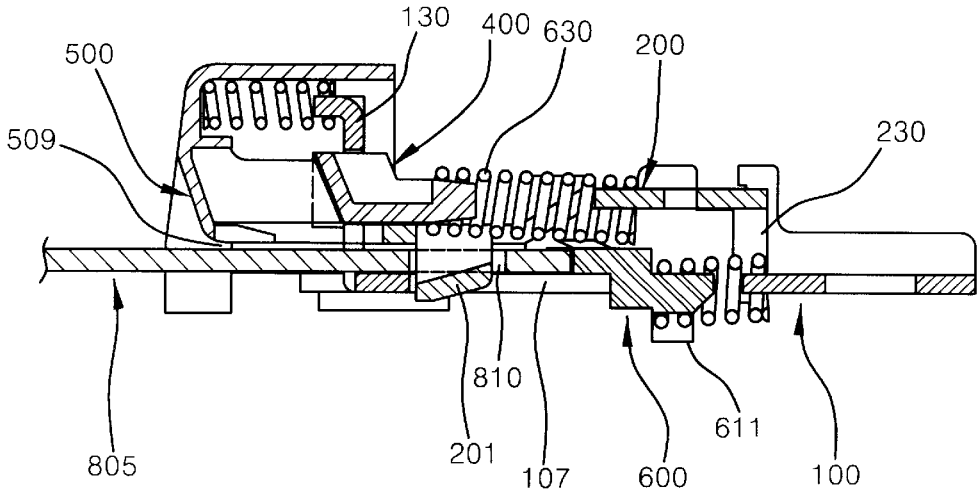

As shown in FIGS. 10A and 10B, an occupant grasps the tongue 805 by the hand, and then, inserts the tongue 805 into the inlet opening 509 of the release button 500 in the longitudinal direction (see an arrow a). By this, as the tongue 805 is inserted into the inlet opening 509 of the release button 500, the tongue 805 pushes rearward the ejector 600. Then, as the ejector 600 slides rearward in the longitudinal direction on the base plate 160 of the body frame 100 along the ejector sliding opening 107, the ejector 600 pushes rearward the legs 230 of the locking lever 200 (see an arrow b). Also, the hall sensor projection 611 of the ejector 600 switches on the hall sensor (not shown), thereby to turn on the hall sensor lamp (not shown) which is installed on the instrument panel disposed inside the cabin of the motor vehicle.

At the same time with this, the locking lever 200 is pivotally rotated downward by the predetermined angle (see an arrow c). The lock bar 201 of the locking lever 200 which is in this way, is inserted into the aperture 810 which is defined in the tongue 805, to latch the tongue 805 to the seat belt buckle. At this time, the slider 400 which is slidably coupled to the locking lever 200, is also integrally rotated with the locking lever 200 and then is fitted into a space which is defined between the supporting beam 130 of the body frame 100 and the locking lever 200, by the elastic force of the third spring 630 (see an arrow d). In this case, because the slider 400 is supported by the supporting beam 130, the slider 400 limits upward and downward movement of the locking lever 200.

Figure 10C:
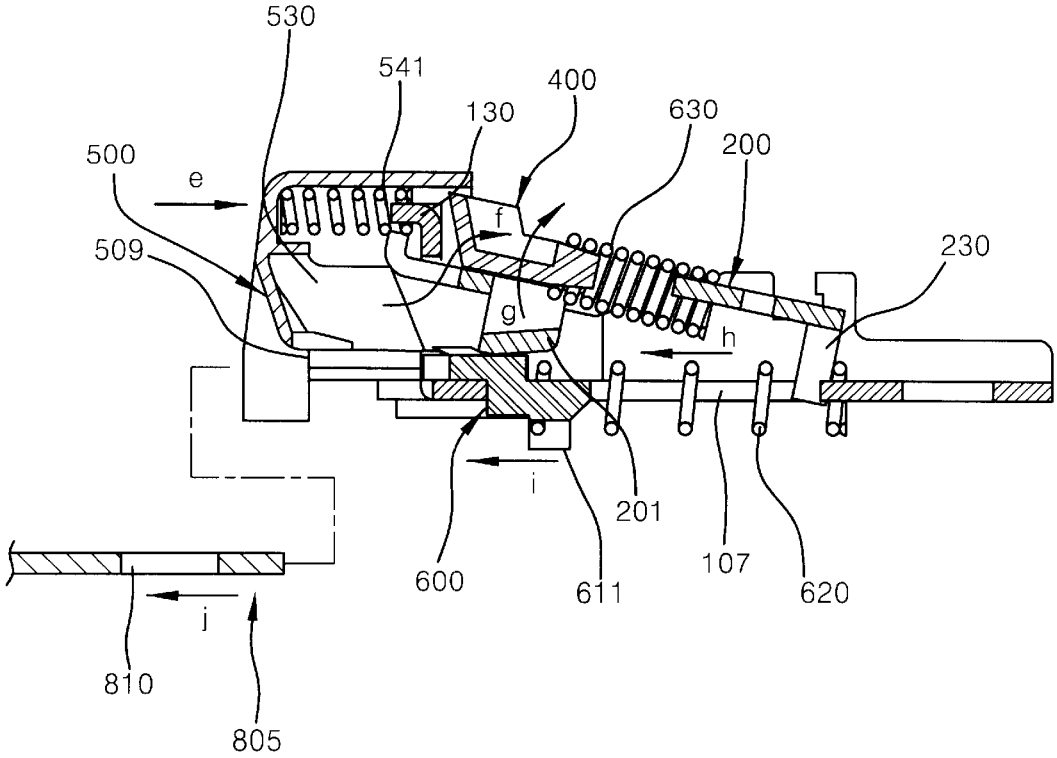

Also, as shown in FIG. 10C, when it is required to unlatch the tongue 805 from the seat belt buckle, the occupant presses the release button 500 in the longitudinal direction (see an arrow e). By this, the release projection 530 of the release button 500 is brought into contact with the inclined projections 411 of the slider 400, and then pushes the slider 400 rearward in the longitudinal direction, thereby to remove the slider 400 from the space which is defined between the supporting beam 130 and the locking lever 200 (see an arrow f). Thereafter, the locking lever 200 is pivotally rotated upward along with the slider 400 by virtue of the elastic force of the third spring 630 by the predetermined angle (see an arrow g). At this time, the upward pivoting rotation of the slider 400 and the locking lever 200 is limited to the predetermined angle by the inner surface of the upper wall of the release button 500, whereby they are returned to their original positions. The lock bar 201 of the locking lever 200 is released from the aperture 810 of the tongue 805. At the same time, the legs 230 of the locking lever 200 push forward ejector 600 in the longitudinal direction (see an arrow h), and the ejector 600 slides forward on the base plate 130 by virtue of the elastic force of the second spring 620 (see an arrow i). The ejector 600 discharges the seat belt tongue 805 out of the buckle assembly (see an arrow j). By this, the release button 500 is returned to its original position by virtue of the elastic force of the first spring 541.

As a result, the seat belt buckle according to the present invention provides advantages in that, since several structural components are integrated with a body frame by performing a pressing process for a single plate member and a manufacturing and assembling procedure is remarkably simplified, durability of the seat belt buckle is ensured and manufacturing cost is reduced.

Also, the seat belt buckle according to the present invention has additional safety measures such as hall sensors which are arranged inside the seat belt buckle, and, nevertheless, possesses a compact design including a locking lever which has relatively a short length in a longitudinal direction and an ejector which has an upper plate of substantially a thin plate-shaped configuration. By this, operational capability of the locking lever is improved and compactness and high quality of the seat belt buckle are achieved.

Further, in the seat belt buckle according to the present invention, because a slider has a width which is greater than that of the body frame, and force for releasing the locking lever out of an aperture which is defined in a tongue, is applied to the slider adjacent to both widthwise ends of a release button, smooth and swift operation of the seat belt buckle is realized, and thereby, the release button is prevented from fluctuating upon application of force.

Moreover, in the seat belt buckle according to the present invention, by the fact that a plurality of shock-absorbing grooves are defined in a damping block of the slider, shock which is generated upon operation of the seat belt buckle, can be effectively absorbed by the shock-absorbing grooves, whereby durability and operational reliability of the seat belt buckle are guaranteed.

Furthermore, in the seat belt buckle according to the present invention, safety can be maximally accomplished in view of the hall sensors which are additionally provided to the seat belt buckle and upper and lower casings which are rigidly assembled with each other.

Besides, in the seat belt buckle according to the present invention, due to the fact that the slider is formed with hooks which are engaged to the locking lever, separate clamping jigs are not needed when the slider is coupled to the locking lever through a spring, whereby an assembling time is shortened and productivity is increased.

In the drawings and specification, there have been disclosed typical preferred embodiments of the invention and, although specific terms are employed, they are used in a generic and descriptive sense only and not for purposes of limitation, the scope of the invention being set forth in the following claims.

What is claimed is:

1. A seat belt buckle comprising:

a body frame including a base plate and a pair of upstanding side walls;

a release button slidably coupled to the body frame for unlatching a seat belt tongue from the seatbelt buckle;

a locking lever capable of being pivotally rotated about wings by a predetermined angle;

a slider for supporting and fixing the locking lever; and an ejector for pushing the tongue in a longitudinal direction which is a lengthwise direction of the body frame; the body frame having an arch-shaped supporting beam which is integrally formed with the body frame in a manner such that the supporting beam is erected in a vertical direction, the supporting beam serving to limit movement of the slider and increase structural rigidity of the seat belt buckle;

the slider having a width which is greater than that of the body frame and possessing shock-absorbing means for increasing durability of the seat belt buckle, the slider being formed with inclined projections; and the release button having at least two release projections which are formed with inclined surfaces which are in turn brought into contact with the inclined projections of the slider, wherein the upstanding side walls of the body frame are formed with release-preventing pieces for preventing the ejector from being released out of the body frame while the ejector slides on the base plate of the body frame.

2. A seat belt buckle comprising:

a body frame;

a release button slidably coupled to the body frame for unlatching a seat belt tongue from the seatbelt buckle;

a locking lever capable of being pivotally rotated about wings by a predetermined angle;

a slider for supporting and fixing the locking lever; and an ejector for pushing the tongue in a longitudinal direction which is a lengthwise direction of the body frame; the body frame having an arch-shaped supporting beam which is integrally formed with the body frame in a manner such that the supporting beam is erected in a vertical direction, the supporting beam serving to limit movement of the slider and increase structural rigidity of the seat belt buckle;

the slider having a width which is greater than that of the body frame and possessing shock-absorbing means for increasing durability of the seat belt buckle, the slider being formed with inclined projections; and the release button having at least two release projections which are formed with inclined surfaces which are in turn brought into contact with the inclined projections of the slider, wherein a crescent-shaped groove is defined in the release button, the crescent-shaped groove allowing one end of a spring to be inserted into a spring seating portion and to be secured therein.

3. A seat belt buckle comprising:

a body frame;

a release button slidably coupled to the body frame for unlatching a seat belt tongue from the seatbelt buckle;

a locking lever capable of being pivotally rotated about wings by a predetermined angle;

a slider for supporting and fixing the locking lever; and an ejector for pushing the tongue in a longitudinal direction which is a lengthwise direction of the body frame; the body frame having an arch-shaped supporting beam which is integrally formed with the body frame in a manner such that the supporting beam is erected in a vertical direction, the supporting beam serving to limit movement of the slider and increase structural rigidity of the seat belt buckle;

the slider having a width which is greater than that of the body frame and possessing shock-absorbing means for increasing durability of the seat belt buckle, the slider being formed with inclined projections; and the release button having at least two release projections which are formed with inclined surfaces which are in turn brought into contact with the inclined projections of the slider, wherein at least two shock-absorbing projections for absorbing shock which is transmitted from the ejector, are formed on an inner surface of the release button.

4. A seat belt buckle comprising:

a body frame including a base plate and a pair of upstanding side walls;

a release button slidably coupled to the body frame for unlatching a seat belt tongue from the seatbelt buckle;

a locking lever capable of being pivotally rotated about wings by a predetermined angle;

a slider for supporting and fixing the locking lever; and an ejector for pushing the tongue in a longitudinal direction which is a lengthwise direction of the body frame; the body frame having an arch-shaped supporting beam which is integrally formed with the body frame in a manner such that the supporting beam is erected in a vertical direction, the supporting beam serving to limit movement of the slider and increase structural rigidity of the seat belt buckle;

the slider having a width which is greater than that of the body frame and possessing shock-absorbing means for increasing durability of the seat belt buckle, the slider being formed with inclined projections; and the release button having at least two release projections which are formed with inclined surfaces which are in turn brought into contact with the inclined projections of the slider, wherein guiding portions for the release button are integrally formed with the body frame adjacent to a front end and both widthwise ends of a base plate of the body frame in a manner such that the guiding portions extend in the longitudinal direction, the guiding portions serving to minimize fluctuation of the release button upon sliding movement of the release button and, both upstanding side walls of the body frame are formed with release-preventing pieces for preventing the ejector from being released out of the body frame while the ejector slides on the base plate of the body frame.

5. A seat belt buckle comprising:

a body frame;

a release button slidably coupled to the body frame for unlatching a seat belt tongue from the seatbelt buckle;

a locking lever capable of being pivotally rotated about wings by a predetermined angle;

a slider for supporting and fixing the locking lever; and an ejector for pushing the tongue in a longitudinal direction which is a lengthwise direction of the body frame; the body frame having an arch-shaped supporting beam which is integrally formed with the body frame in a manner such that the supporting beam is erected in a vertical direction, the supporting beam serving to limit movement of the slider and increase structural rigidity of the seat belt buckle;

the slider having a width which is greater than that of the body frame and possessing shock-absorbing means for increasing durability of the seat belt buckle, the slider being formed with inclined projections; and the release button having at least two release projections which are formed with inclined surfaces which are in turn brought into contact with the inclined projections of the slider, wherein guiding portions for the release button are integrally formed with the body frame adjacent to a front end and both widthwise ends of a base plate of the body frame in a manner such that the guiding portions extend in the longitudinal direction, the guiding portions serving to minimize fluctuation of the release button upon sliding movement of the release button and, a crescent-shaped groove is defined in the release button, the crescent-shaped groove allowing one end of a spring to be inserted into a spring seating portion to be secured therein.

* * * * *